US005100118A

United States Patent [19]

Hobbs et al.

[11] Patent Number: 5,100,118

[45] Date of Patent: Mar. 31, 1992

[54] SHEET MATERIAL HANDLING APPARATUS

[75] Inventors: John N. Hobbs, Troy; Robert A. Bryson, Sr., Huber Heights, both of Ohio

[73] Assignee: AM International Incorporated, Chicago, Ill.

[21] Appl. No.: 605,396

[22] Filed: Oct. 29, 1990

[51] Int. Cl.[5] ..... B42B 2/00

[52] U.S. Cl. ..... 270/53; 270/54

[58] Field of Search ..... 270/53, 54, 55, 57, 270/58; 271/18, 109; 83/88, 86, 925

[56] References Cited

U.S. PATENT DOCUMENTS

| | | | |
|---|---|---|---|
| 2,251,943 | 8/1941 | Kleineberg . | |
| 2,917,307 | 12/1959 | Biel | 270/53 |
| 3,481,594 | 12/1969 | McCain et al. . | |
| 3,510,119 | 5/1970 | Linden | 270/54 |
| 3,544,097 | 12/1970 | Linden | 270/54 |
| 3,733,947 | 5/1973 | Bryson et al. . | |
| 3,811,350 | 5/1974 | Marciniak . | |
| 4,076,231 | 2/1978 | Kutzner | 270/54 |
| 4,196,835 | 4/1980 | Schlough . | |
| 4,236,706 | 12/1980 | Schlough | 270/54 |
| 4,260,145 | 4/1981 | Mebus | 270/54 |
| 4,299,378 | 11/1981 | Muller | 270/54 |
| 4,402,496 | 9/1983 | Muller . | |
| 4,479,642 | 10/1984 | Macey . | |
| 4,511,131 | 4/1985 | Roybuck | 270/54 |
| 4,601,462 | 7/1986 | Bowman | 270/53 |
| 4,641,825 | 2/1987 | Mowry et al. . | |

*Primary Examiner*—Edward K. Look
*Assistant Examiner*—Therese M. Newholm
*Attorney, Agent, or Firm*—Tarolli, Sundheim & Covell

[57] ABSTRACT

An improved sheet material handling apparatus includes a pair of saddle conveyors. An extractor drum sequentially grips folded edge portions of signatures in hoppers and moves the signatures along an arcuate path. During rotation of the extractor drum to move the signatures along the arcuate path, a first signature engages a first stop member and is transferred to a first saddle conveyor. The first stop member is then retracted and the next signature moves past the first stop member into engagement with a second stop member. The second signatures is then transferred to a second saddle conveyor. A single stitcher assembly is provided to stitch signatures in first and second spaced apart streams of signatures being conveyed by the two saddle conveyors. In addition, a single trimmer assembly is provided to trim the signatures while maintaining the signatures in the first and second spaced apart streams of signatures.

52 Claims, 3 Drawing Sheets

SHEET MATERIAL HANDLING APPARATUS

BACKGROUND OF THE INVENTION

The present invention relates to a new and improved sheet material handling apparatus, and more specifically, to a sheet material handling apparatus having an improved mechanism for feeding signatures from hoppers to a pair of conveyors, an improved mechanism for stitching signatures, and an improved mechanism for trimming signatures.

Known mechanisms for feeding signatures from hoppers onto saddle conveyors are disclosed in U.S. Pat. Nos. 2,251,943 and 3,481,594. The signature feed mechanisms disclosed in these patents include a rotatable extractor drum having a gripper which grips a folded edge portion of a signature disposed in a hopper. The extractor drum moves a gripped signature from the hopper along an arcuate path until the folded edge portion of the signature engages a stop member. The trailing edge portion of the signature is then engaged by a transfer cylinder and moved to an opener cylinder. The opener cylinder cooperates with the transfer cylinder to open the signature over the saddle conveyor. The signature is then deposited on the saddle conveyor.

Both of the foregoing patents disclose signature feed mechanisms which transfer signatures from hoppers to a single conveyor. In U.S. Pat. No. 3,544,097 signatures are transferred from a hopper to a pair of flat conveyors. Thus, the signatures are removed from the hoppers by an extractor drum and moved to either one of a pair of transfer drums. Each of the transfer drums is operable to move a signature onto a conveyor. A somewhat different apparatus for transferring signatures from a hopper to a plurality of conveyors is disclosed in U.S. Pat. No. 4,402,496.

It is a rather common practice to stitch or staple signatures as they are being moved by a conveyor. Thus, U.S. Pat. No. 4,196,835 discloses a stitcher assembly which is operable to stitch signatures as they are being moved along a linear path by a saddle conveyor. A somewhat different type of stitcher assembly is disclosed in U.S. Pat. No. 4,641,825.

In addition, there are several known types of mechanisms for trimming signatures. One of these known mechanisms is disclosed in U.S. Pat. No. 3,811,350. This known trimmer includes a front knife which trims the front edge portion of a signature and a plurality of side knives which trim foot and head portions of the signature. In this known trimmer, the side knives are operable to split the signature assembly to form two separate signature assemblies.

Another known trimmer is disclosed in U.S. Pat. No. 3,733,947. This patent discloses a trimmer which is operable to trim books without stopping their forward movement. The trimmer includes a front knife which trims a book while it is on a movable front table. The book is then transferred to a movable side table where side knives complete the trimming of the book.

SUMMARY OF THE INVENTION

The present invention relates to a new and improved sheet material handling apparatus having an improved feed mechanism for feeding signatures from a hopper to a pair of conveyors. The improved feed mechanism includes an extractor which sequentially grips edge portions of signatures and moves the signatures along an arcuate path into engagement with either a movable stop or a stationary stop which is disposed further along the arcuate path than the movable stop. The signatures which engage the movable stop are transferred to a first conveyor of the pair of conveyors. The signatures which engage the stationary stop are transferred to a second conveyor of the pair of conveyors. The first stop is movable so that it can be retracted out of the arcuate path of movement of the signatures to enable every second signature to move into engagement with the stationary stop. This results in half of the signatures from a hopper being transferred to the first conveyor to form part of a first stream of signatures and the other half of the signatures being transferred to the second conveyor to form part of a second stream of signatures.

A single stitcher assembly is provided to stitch signatures in the first and second streams of signatures. In addition, a single trimmer assembly is provided to trim the signatures in the first and second streams of signatures. Since half of the signatures are fed from each hopper to each conveyor to form two streams of signatures, the conveyors, stitcher assembly and trimmer assembly can all be operated at a relatively slow rate which is equal to one-half of the rate at which signatures are fed from the hoppers.

Accordingly, it is an object of this invention to provide a new and improved sheet material handling apparatus having an improved signature feed assembly for feeding signatures from hoppers onto a plurality of conveyors to form a plurality of streams of signatures, an improved stitcher assembly for stitching signatures in the plurality of streams of signatures, and an improved trimmer assembly for trimming the signatures in the streams of signatures.

Another object of this invention is to provide a new and improved signature feed assembly for feeding signatures onto a pair of conveyors and wherein the signature feed assembly includes a stop which is movable between an extended position and a retracted position, a first transfer assembly for transferring signatures which engage the stop to a first one of a pair of conveyors and a second transfer assembly for transferring the other signatures to a second conveyor.

Another object of this invention is to provide a new and improved sheet material handling apparatus having a single stitcher assembly for stitching signatures which are moving in a plurality of spaced apart streams of signatures.

Another object of this invention is to provide a new and improved sheet material handling apparatus having a trimmer assembly for trimming signatures disposed in a plurality of spaced apart streams of signatures.

BRIEF DESCRIPTION OF THE DRAWINGS

The foregoing and other objects and features of the present invention will become more apparent upon a consideration of the following description taken in connection with the accompanying drawings, wherein.

DESCRIPTION OF SPECIFIC PREFERRED EMBODIMENTS OF THE INVENTION

Sheet Material Handling Apparatus

Figure 1:
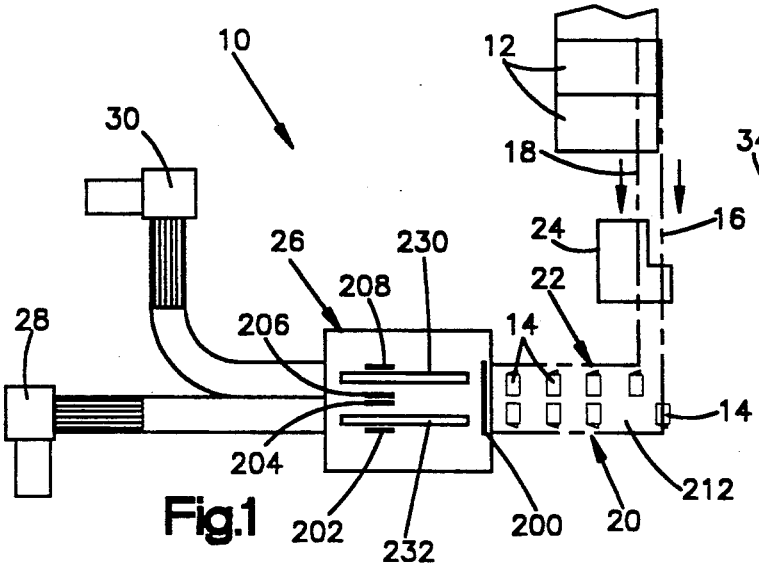
FIG. 1 is a schematic plan view of a sheet material handling apparatus constructed in accordance with the present invention.
Figure 2:
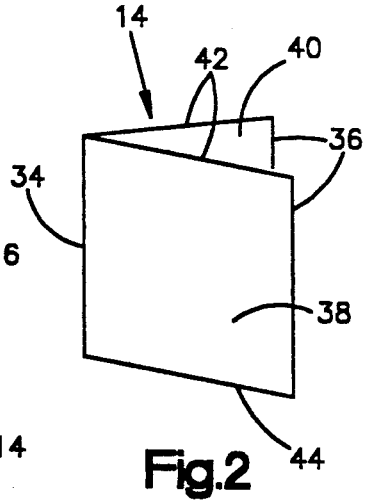
FIG. 2 is an illustration of a folded signature upon which operations are performed by the sheet material handling apparatus of FIG. 1
Figure 3:
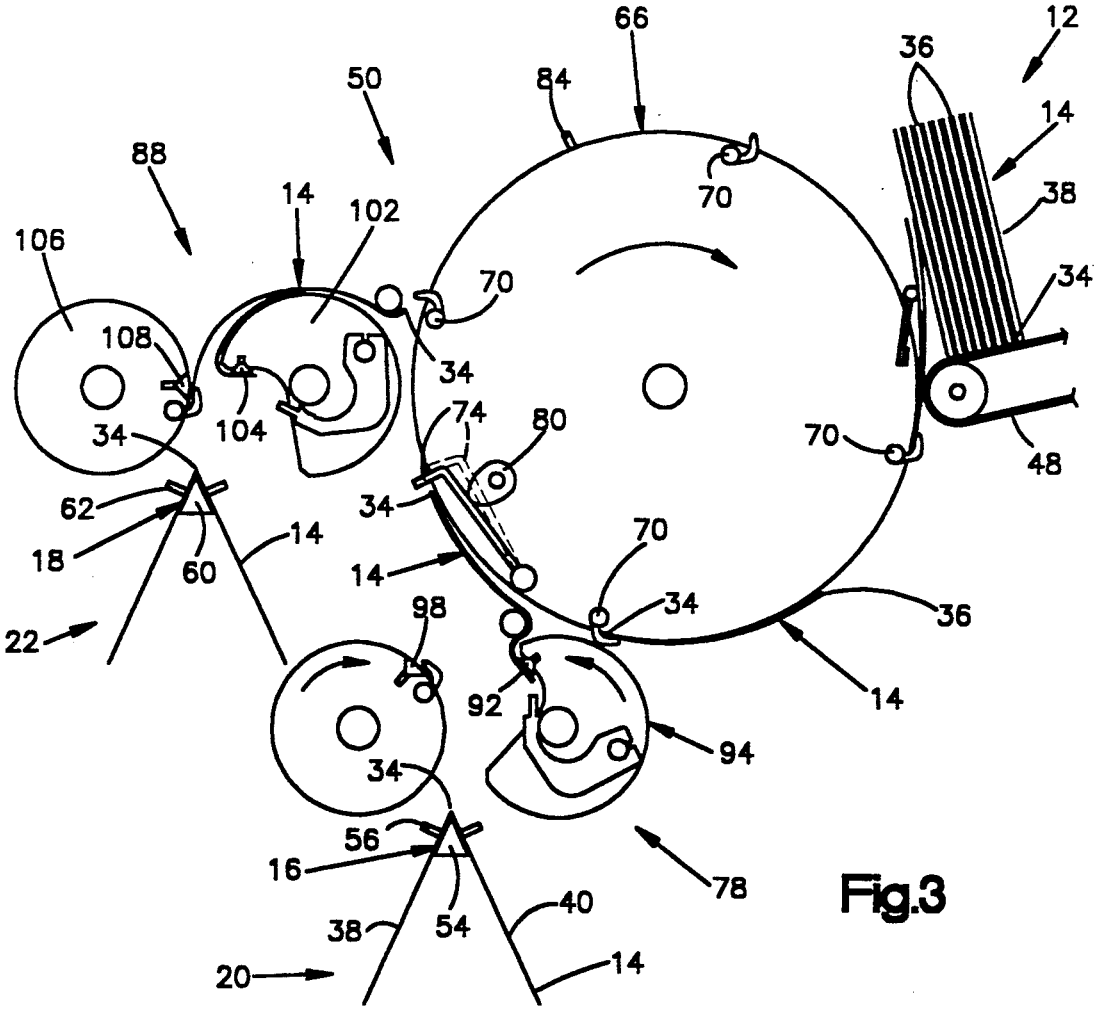
FIG. 3 is a schematic elevational view of a feeder assembly, used in the apparatus of FIG. 1, to feed folded signatures from a hopper onto a pair of saddle conveyors to form two streams of signatures.
Figure 4:
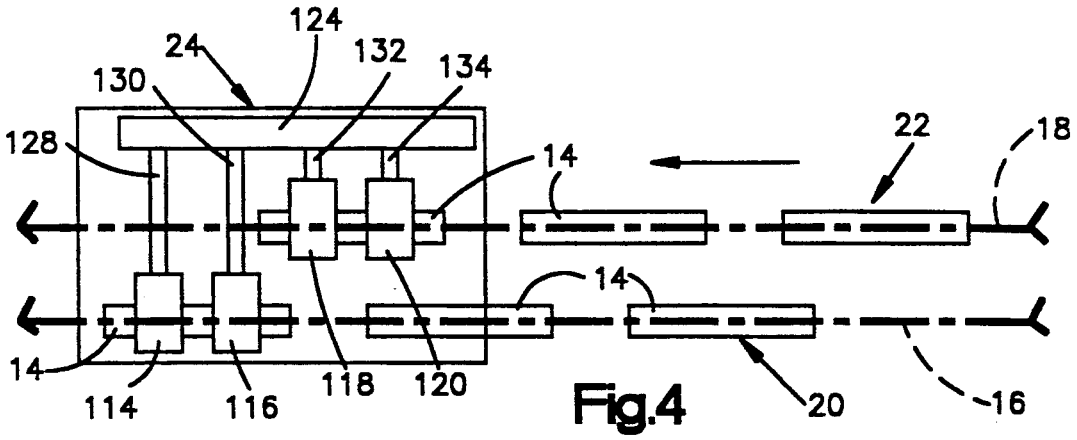
FIG. 4 is a plan view of a stitcher assembly, used in the apparatus of FIG. 1, to stitch signatures moving in the streams of signatures.

An improved sheet material handling apparatus 10 constructed in accordance with the present invention is illustrated in FIG. 1. The sheet material handling apparatus 10 includes a plurality of hoppers 12 which are disposed in a linear array. Each of the hoppers 12 holds a stack of signatures 14 (FIG. 2). A pair of conveyors 16 and 18 (FIGS. 1 and 3) extend beneath the hoppers 12 and convey first and second steams 20 and 22 of signatures 14 through one stitcher assembly 24 (FIGS. 1 and 4).

The single stitcher assembly 24 is operable to stitch signatures 14 in the two streams 20 and 22 while they are being moved by the first and second conveyor assemblies 16 and 18. In addition, one trimmer assembly 26 is provided to trim the signatures 14 while they are being moved in the two streams 20 and 22 of signatures. From the trimmer assembly 26, the two streams of signatures are conducted to stackers 28 and 30.

Each of the signatures 14 has a folded edge portion 34 (FIG. 2) and an open edge portion 36 opposite from the folded edge portion. Front and rear side panels 38 and 40 extend between the folded and open edge portions 34 and 36. In addition, the signature 14 has a head or upper edge portion 42 and a lower or foot edge portion 44.

The hoppers 12 (FIG. 1) are disposed in a linear array. A plurality of signatures 14 are stacked in each of the hoppers 12 with the folded edge portions 34 downwardly and the front and rear side panels 38 and 40 in an upright orientation (FIG. 3). Each of the hoppers 12 include parallel side panels and parallel front and rear panels (not shown) A feed belt 48 supports the upright signatures 14 and moves the signatures toward a feed assembly 50. The hoppers may have a construction similar to that disclosed in U.S. Pat. No. 2,251,943.

The conveyors 16 and 18 extend parallel to each other along the length of the linear array of the hoppers 12 (FIG. 1) and receive signatures from each of the hoppers in turn to form groups of signatures. The conveyors 16 and 18 are of the well known saddle type. Thus, the conveyor 16 includes an elongated ridge portion 54 (FIG. 3). A plurality of chain driven pushers 56 ar effective to push the groups of signatures 14 along the ridge portion 54 to form the stream 20 of signatures.

Similarly, the conveyor 18 has an elongated ridge portion 60 which engages signatures 14. A plurality of pushers 62 move groups of signatures 14 along the ridge portion 60 to form the second stream 22 of signatures. Although parallel saddle type conveyors 14 and 16 have been shown in FIG. 3, it is contemplated that other types of conveyors could be used. For example, it may be preferred to use conveyors similar to those disclosed in U.S. Pat. Nos. 3,544,097 and 3,510,119.

Feed Assembly

The signature feed assembly 50 (FIG. 3) is operable to sequentially feed signatures from a hopper 12 to both the first and second conveyors 16 and 18. Thus, a single feed assembly 50 is operable to transfer a first signature from the hopper 12 to the first conveyor 16 and then to transfer a second signature from the hopper 12 to the second conveyor 18. This results in every second signature fed from the hopper 12 being transferred to the conveyor 16 with the other signatures being transferred to conveyor 18.

The feed assembly 50 includes a cylindrical extractor drum 66 which is rotatable in a clockwise direction (as viewed in FIG. 3) about its central axis to sequentially feed signatures 14 from the hopper 12. A plurality of grippers 70 are mounted at evenly spaced apart locations about the periphery of the cylindrical extractor drum 66. The grippers 70 are operable, in a known manner, to grip the folded lower edge portion of each of the signatures 14 in turn as the extractor drum 66 is rotated about its central axis.

After a gripper 70 has engaged the folded edge portion 34 of a signature in the hopper 12, the gripper pulls the signature out of the hopper as the extractor drum 66 rotates. During continued rotation of the extractor drum 66, the signature 14 is moved along an arcuate path. The folded edge portion 34 of the signature 14 is leading and the open edge portion 36 of the signature is trailing.

As a signature 14 is moved along the arcuate path by the extractor drum 66, the folded leading edge portion 34 of the signature moves into engagement with a stationary movable stop member 74. When this happens, the signature is disengaged from the gripper 70 by engagement with the stationary movable stop 74. The open trailing edge portion 36 of the signature is then engaged by a first transfer assembly 78.

As the next succeeding signature 14 is moved along the arcuate path by the next extractor drum gripper 70, the movable stop 74 is retracted from the extended position shown in solid lines in FIG. 3 to the retracted position shown in dashed lines in FIG. 3. The stop 74 is moved in response to rotation of a cam 80. When the movable stop 74 is in the retracted position, it is out of the path of movement of the next succeeding signature 14.

The folded leading edge portion 34 of the next succeeding signature 14 is moved past the retracted movable stop 74 into engagement with a stationary fixed stop 84. Upon engagement of the next succeeding signature with the fixed stop 84, a second transfer assembly 88 engages the open trailing edge portion 36 of the signature.

The cam 80 is operable to move the movable stop 74 between extended and retracted positions in timed relationship with rotation of the extractor drum 66. Therefore, the folded leading edge portion 34 of every other signature engages the movable stop 74. This results in every other signature, that is the signatures which do not engage the movable stop 74, being moved into engagement with the fixed stop 84 by the extractor drum 66.

The first and second transfer assemblies 78 and 80 are operable to open the signatures 14 and transfer them to the conveyor assemblies 16 and 18. Thus, the transfer assembly 78 is operable to engage a trailing edge portion 36 of each of the signatures 14 as it moves into engagement with the movable stop 74. The transfer assembly 78 then opens the signature 14 and transfers the opened signature to the first conveyor 16.

As the folded leading edge portion 34 of a signature 14 engages the extended movable stop 74, a gripper 92 on a cylindrical transfer drum 94 (FIG. 3) in the first transfer assembly 78 engages the open trailing edge portion 36 of the signature 14. The transfer drum 98 rotates in a counterclockwise direction (as viewed in FIG. 3). Therefore, the transfer drum 98 moves the open edge portion 36 of a signature 14 toward a cylindrical opener drum 96. A gripper 98 on the opener drum 96 engages a side panel of the signature to move the two side panels apart and open the signature.

The opened signature 14 is dropped downwardly onto the saddle conveyor 16. As the open signature 14 is dropped downwardly onto the elongated ridge portion 54 of the saddle conveyor 16, the ridge portion of the saddle conveyor engages the inside of the open signature adjacent to the folded edge portion 34. The general manner in which the transfer and opener drums 94 and 96 cooperate with each other to open and transfer a signature to the saddle conveyor 16 is the same as disclosed in U.S. Pat. No. 2,251,943.

The second transfer assembly 88 has the same construction as the first transfer assembly 78. Thus, the second transfer assembly 88 includes a cylindrical transfer drum 102. The transfer drum 102 has a gripper 104 which engages the open trailing edge portion 36 of a signature 14 immediately after the folded leading edge portion 34 of the signature engages the fixed stop 84. An opener drum 106 has a gripper 108 which grips a side panel 38 of the signature 14 and moves it away from the opposite side panel 40 to open the signature. The opened signature is dropped onto an elongated ridge portion 60 of the second conveyor 18.

The two transfer assemblies 78 and 88 and the two conveyors 16 and 18 operate at one-half of the rate at which signatures are withdrawn from the hopper 12 by the extractor drum 66. This is because the extractor drum removes twice as many signatures from the hopper 12 as are deposited on any one of the two conveyors 16 and 18. This allows the two transfer assemblies 78 and 88 and the two conveyors 16 and 18 to be operated at a relatively low speed which is conducive to accurate handling of the signatures 14.

Although only a single feed assembly 50 for one of the hoppers 12 is illustrated in FIG. 3, it should be understood that a feed assembly 50 is provided for each of the hoppers 12. Thus, the parallel saddle type conveyors 16 and 18 extend beneath the linear array of hoppers 12 and a linear array of feed assemblies 50. The feed assemblies 50 are operable to transfer signatures from the hoppers 12 to receiving locations on the conveyor 16 and on the conveyor 18. This results in the formation of a gather containing a signature from each of the hoppers 12 at each of the receiving locations on each of the conveyors 16 and 18. Since two signatures are removed from each of the hoppers 12 for any one signature transferred to a receiving location on a conveyor 16 or 18, the rate of operation of the conveyors 16 and 18 is one-half the rate of removal of signatures from the hoppers 12.

Stitcher Assembly

One stitcher assembly 24 (FIG. 4) is operable to simultaneously stitch signatures in the first and second streams 20 and 22 of signatures. Thus, a pair of stitcher heads 114 and 116 are operable to stitch (staple) folded edge portions 34 of signatures 14 being conveyed in the first stream 20 by the saddle conveyor 16. Similarly, a pair of stitcher heads 118 and 120 are operable to stitch (staple) folded edge portions 34 of signatures 14 being conveyed in the second stream 22 by the saddle conveyor 18.

The stitcher assembly 24 (FIG. 4) includes a single drive assembly 124 which is connected with a first pair of stitcher heads 114 and 116 and the second pair of stitched heads 118 and 120. The drive assembly 124 is operable to reciprocate the stitcher heads 114, 116, 118 and 120 horizontally along the path of movement of the signatures 14 through the stitcher assembly 24. In addition, the drive assembly 124 is operable to reciprocate the stitcher heads 114–120 vertically toward and away from signatures 14 being conveyed by the saddle conveyors 16 and 18. While the stitcher heads 114–120 are being moved forwardly by the drive assembly 124 at the same speed as the signatures 14, the drive assembly moves the stitcher heads 114–120 downwardly to stitch the signatures.

Since both streams 20 and 22 of signatures 14 are stitched at the same time, the stitcher assembly 24 operates at a rate which is one-half of the rate at which signatures are fed from each of the hoppers 12 by the feed assemblies 50. The relatively slow rate of operation of the stitcher assembly 24 promotes the accurate placement of the stitches (staples) in the folded edge portions 34 of the signatures 14. In addition, the slow rate of operation of the stitcher assembly 24 provides a relatively long period of time in which to pierce the signatures 14 with the staples and to clinch the staples.

The stitcher assembly 24 includes members 128, 130, 132 and 134 (FIG. 4) which connect the stitcher heads 114, 116, 118 and 120 with the drive assembly 124. The members 132 and 134 are relatively short since the saddle conveyor 18 is relatively close to the drive assembly 124. However, the members 128 and 130 are relatively long. This is because the members 128 and 130 extend across the saddle conveyor 18 to support the stitcher heads 114 and 116 above the saddle conveyor 16. The drive assembly 124 is connected with each of the members 128, 130, 132 and 134 to reciprocate the members back and forth along the longitudinal central axes of the saddle conveyors 16 and 18.

The stitcher heads 114–120 and signatures 14 are advantageously offset in a staggered relationship along the saddle conveyors 16 and 18 to optimize stitcher head positioning. Thus, the saddle conveyors 16 and 18 are operated in an out-of-phase relationship. Therefore, signatures 14 on the first saddle conveyor 16 lead signatures on the second saddle conveyor 18. This out-of-phase relationship is relatively easy to obtain since the feed assemblies 50 feed the first signature from the hopper 12 to the first conveyor 16 and the second signature from the hopper 12 to the second conveyor 18. Therefore, there is an out-of-phase feeding of signatures from the hoppers 12 to the conveyors 16 and 18 and an out-of-phase stitching of the groups of signatures on the conveyors 16 and 18 by the stitcher assembly 24.

The out-of-phase or staggered relationship between the groups of signatures 14 in the two streams 20 and 22 results in the stitcher heads 114 and 116 being offset forwardly along the conveyor 16 from the stitcher heads 118 and 120. By having the stitcher heads 114 and 116 offset along the path of movement of the conveyors 16 and 18 from the stitcher heads 118 and 120, accessibility of the stitcher heads is promoted.

Figure 5:
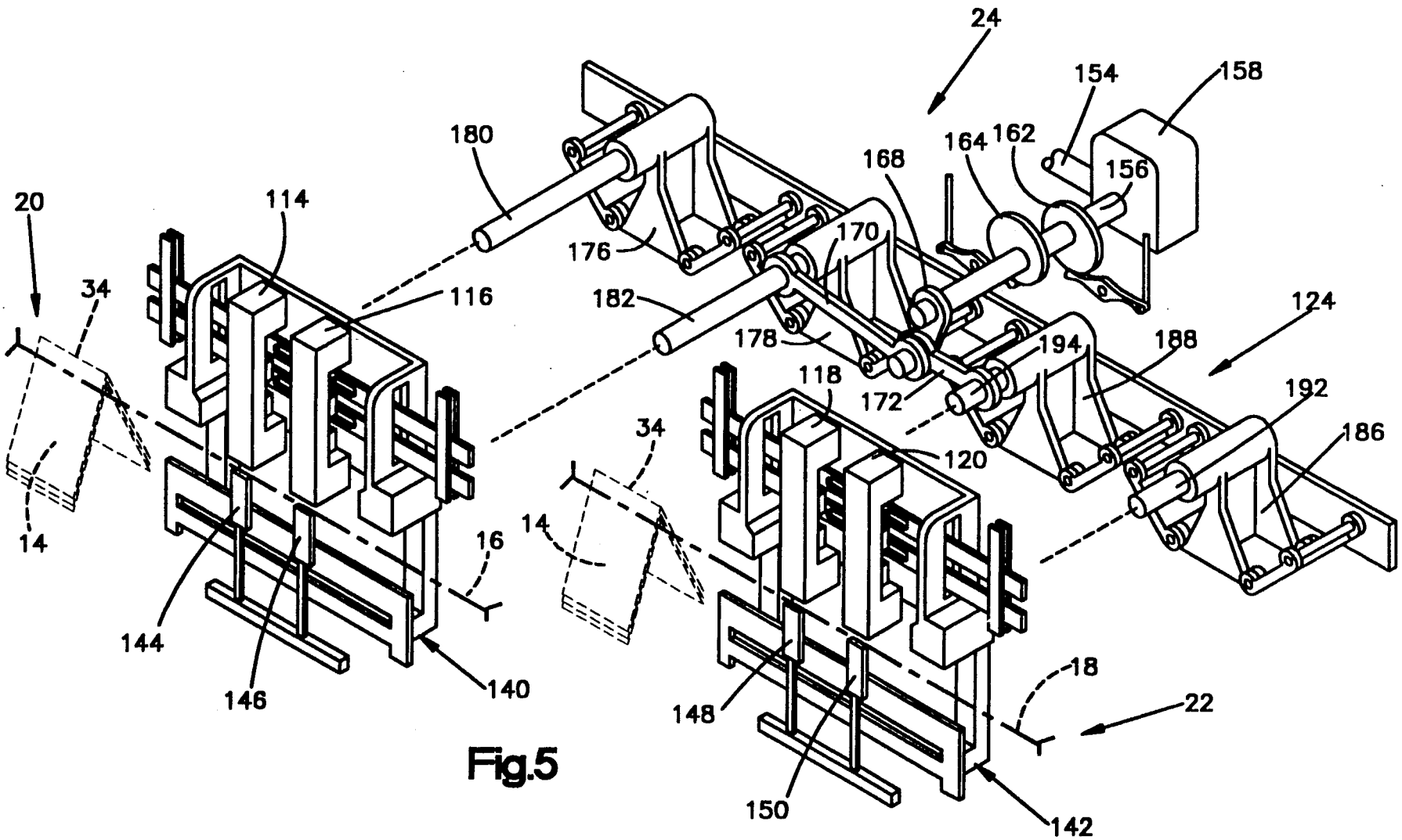
FIG. 5 is a fragmentary exploded view of the stitcher assembly of FIG. 4.

The stitcher assembly 24 may have many different constructions corresponding to different known stitcher assemblies. One specific construction of the stitcher assembly 24 is illustrated in FIG. 5. The stitcher assembly 24 of FIG. 5 includes a movable frame 140 upon which the stitcher heads 114 and 116 are mounted. The stitcher heads 118 and 120 are mounted on a second movable frame 142. Clincher assemblies 144 and 146 are mounted on the frame 140 and cooperate with the stitcher heads 114 and 116 to clinch stitches (staples) in the folded edge portions 34 of the signatures 14. Similarly, clincher assemblies 148 and 150 cooperate with the stitcher heads 118 and 120 to clinch stitches (staples) in the folded edge portions 34 of signatures 14.

The drive assembly 124 (FIG. 5) reciprocates the frames 140 and 142 in unison along paths extending parallel to the longitudinal central axes of the saddle conveyors 16 and 18. In addition, the drive assembly 124 reciprocates the stitcher heads 114–120 in unison vertically to simultaneously stitch signatures carried by the saddle conveyors 16 and 18.

The drive assembly 124 includes a power input shaft 154 which is connected with a drive shaft 156 through a gear reducer unit 158. Rotation of the drive shaft 156 rotates cams 162 and 164 to drive linkages connected with the stitcher heads 114–120. Actuation of the linkages by the cams 162 and 164 reciprocates the stitcher heads vertically relative to the frames 140 and 142 as the frames move horizontally along the paths of movement of the conveyors 16 and 18. Thus, rotation of the cams 162 and 164 moves the stitcher 114–120 downwardly to press stables into the signatures on the conveyors 16 and 18 when the stitcher heads 114–120 are moving in the same direction and at the same speed as the signatures.

To reciprocate the stitcher heads 114–120 along the conveyors 16 and 18, the drive shaft 156 rotates a crank arm 168 which is connected to one end of the drive shaft. Rotation of the crank arm 168 drives connecting rods 170 and 172 in unison. Movement of the connecting rod 170 actuates suspension units 176 and 178 which are connected to the frame 140 by shafts or members 180 and 182. Similarly, movement of the connecting rod 172 actuates suspension units 186 and 188 which are connected with the frame 142 by shafts or members 192 and 194. Actuation of the suspension units 176, 178, 186 and 188 by the connecting rods 170 and 172 reciprocates the frames 140 and 142 along the longitudinal central axes of the conveyors 16 and 18. The construction and mode of operation of the stitcher assembly 24 is generally similar to that disclosed in U.S. Pat. No. 4,196,835.

Although two separate frames 140 and 142 and four suspension units 176, 178, 186 and 188 are provided in the stitcher assembly 24 of FIG. 5, a single frame could be provided in place of the two frames 140 and 142. If this was done, the single frame could be moved by a pair of suspension units in a manner similar to that disclosed in U.S. Pat. No. 4,196,835. Of course, if a single frame is used in place of the frames 140 and 142, the single frame would have to have two offset sections which extend along the longitudinal axes of the conveyors 16 and 18. The stitcher heads 114 and 116 would be mounted on one of the offset sections of the frame and the stitcher heads 118 and 120 would be mounted on the other offset section of the frame. It is believed that this construction of the stitcher assembly 24 may be preferred since it would have fewer operating components and, therefore, may cost less.

Trimmer Assembly

The trimmer assembly 26 (FIG. 1) trims the signatures 14 while maintaining the signatures in the first and second spaced apart streams 20 and 22 of signatures. The trimmer assembly 26 includes a front knife 200 which extends across the first and second streams 20 and 22 of signatures. The front knife 200 is reciprocated vertically to simultaneously trim the open edge portions 36 (FIG. 2) of signatures in the two streams 20 and 22 of signatures.

A first pair of side knives 202 and 204 (FIG. 1) trim the head and foot edge portions 42 and 44 (FIG. 2) of each group of signatures 14 in the first stream 20 (FIG. 1) of signatures. Similarly, a pair of side knives 206 and 208 are operable to trim the head and foot portions of groups of signatures 14 in the second stream 22 of signatures. The two streams 20 and 22 of signatures are maintained in a spaced apart relationship as the signatures move through the trimmer assembly 26.

When the two streams 20 and 22 of signatures are being moved by the saddle conveyors 16 and 18, the folded edge portion 34 (FIG. 2) of the signatures is uppermost and the side panels 38 and 40 extend downwardly on opposite sides of the conveyors 16 and 18. When the signatures 14 move through the trimmer assembly 28, the folded edge portion 34 is leading and the side panels 38 and 40 are generally horizontal with the open edge portions 36 of the signatures trailing. When the signatures 14 are stitched, they are in an out-of-phase relationship. However, when the signatures 14 are trimmed, they are in an in-phase relationship. Therefore, the signatures 14 are transferred from the saddle conveyors 16 and 18 to a flat conveyor 212 (FIG. 1) for in-phase movement through the trimmer assembly 26.

To transfer the signatures 14 from the saddle conveyors 16 and 18 to the flat conveyor 212 (FIG. 1) and to change the signatures from an out-of-phase relationship to an in-phase relationship, a delivery assembly is provided in association with each of the saddle conveyors 16 and 18 to deliver signatures to the conveyor 212. Each of the delivery assemblies (not shown) includes a pair of pick up rollers and a tucker blade which moves the folded edge portion of each group of signatures upwardly to a nip formed by the pick up rollers. The pick up rollers then move the signatures onto the conveyor 212 with the folded edge portions 34 leading. The construction and mode of operation of the delivery assembly for transferring signatures from the saddle conveyors 16 and 18 is well known and is similar to that disclosed in U.S. Pat. No. 4,498,663.

Figure 6:
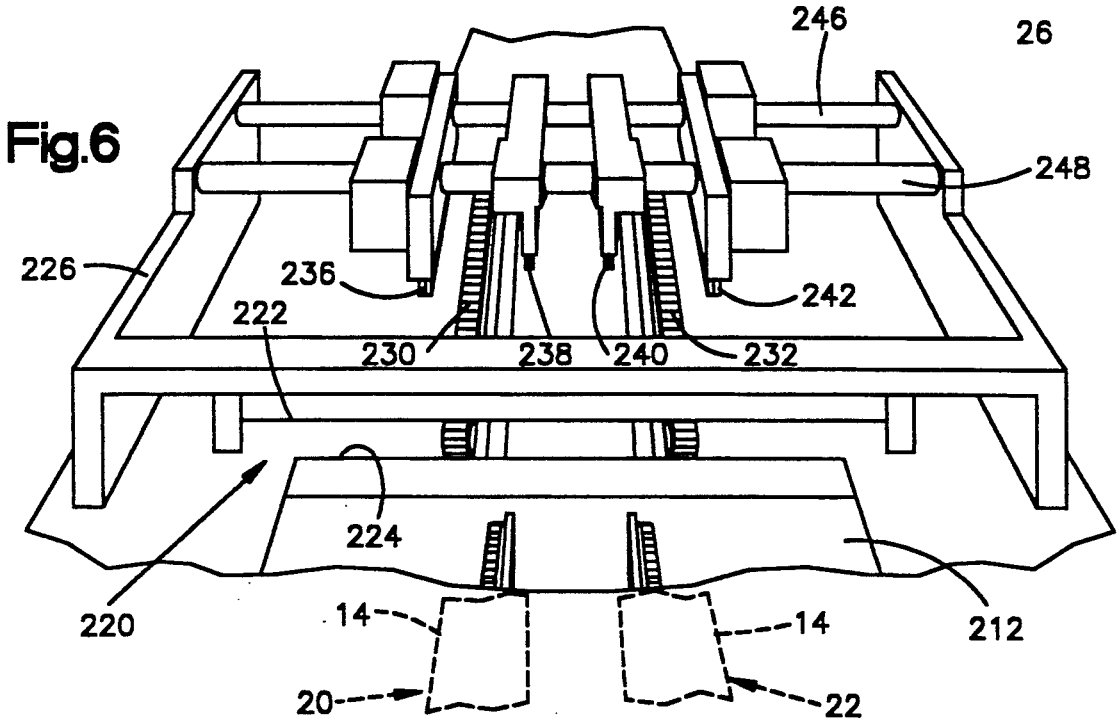
FIG. 6 is a schematicized pictorial illustration of a trimmer assembly, used in the apparatus of FIG. 1, to trim streams of signatures.

The trimmer assembly 26 may have many different constructions. In one specific embodiment, the trimmer assembly 26 included a front or face knife 220 (FIG. 6) corresponding to the front knife 200 of FIG. 1. The front or face knife 220 includes a movable upper blade 222 and a fixed or stationary lower blade 224 (FIG. 6). The movable upper blade 222 of the front knife is reciprocated through cutting and return strokes relative to the fixed knife 224 by vertical movement of a generally rectangular frame assembly 226.

During downward movement of the frame assembly 226, the front knife 220 trims the open edge portion 36 of a group of signatures 14 in the stream 20 of signatures and a group of signatures 14 in the stream 22 of signatures. Thus, on each cutting stroke of the movable upper knife 222, the open edge portions of two groups of signatures 14 in the two streams 20 and 22 are simultaneously trimmed by the front knife 220. While the groups of signatures in the streams 20 and 22 are being simultaneously trimmed, they are clampingly held in registration with the front knife 220 by a pair of tooth timing conveyor belts 230 and 232. The conveyor belts 230 and 232 grip signatures 14 adjacent to the folded edge portions of the signatures.

After the open edge portions of groups of signatures 14 in the two streams 20 and 22 of signatures have been trimmed by the front knife 220, the conveyor belts 230 and 232 are activated to move the groups of signatures in the two streams 20 and 22 away from the front knife 220 toward two pairs of side knives. Thus, a first pair of side knives 236 and 238, corresponding to the side knives 202 and 204 of FIG. 1, are provided to trim sheet material assemblages 14 in the first stream 20 of signatures. A second pair of side knives 240 and 242, corresponding to the side knives 206 and 208 of FIG. 1, are provided to trim signatures 14 in the second stream 22 of signatures.

The side knives 236, 238, 240 and 242 are mounted on parallel horizontal bars 246 and 248 for movement with the side frame 226. Thus, during each downward stroke of the side frame 226, the front knife 220 trims the open edge portion of the group of signatures in the stream 20 and a second group of signatures in the stream 22. At the same time, the side knives 236 and 238 trim the head and foot edge portions of a group of signatures 14 in the stream 20. In addition, the side knives 240 and 242 trim the head and foot edge portions of a group of signatures in the stream 22. Thus, each time the frame 226 is moved downwardly through a cutting stroke, four groups of signatures are trimmed, that is, two groups of signatures in the stream 20 and two groups of signatures in the stream 22. The construction and mode of operation of the trimmer assembly 26 is similar to the construction and mode of operation of the trimmer assembly disclosed in U.S. Pat. No. 3,811,350.

Trimmer Assembly—Second Embodiment

In the embodiment of the trimmer assembly illustrated in FIGS. 1 and 6, the side knives are positioned adjacent to each other. However, it is contemplated that it may be desirable to offset the side knives relative to each other to facilitate providing access to the side knives. It is also contemplated that a different type of trimmer assembly than the trimmer assembly illustrated in FIG. 6 may be used. Specifically, it is contemplated that it may be preferred to use a flying trimmer assembly.

Figure 7:
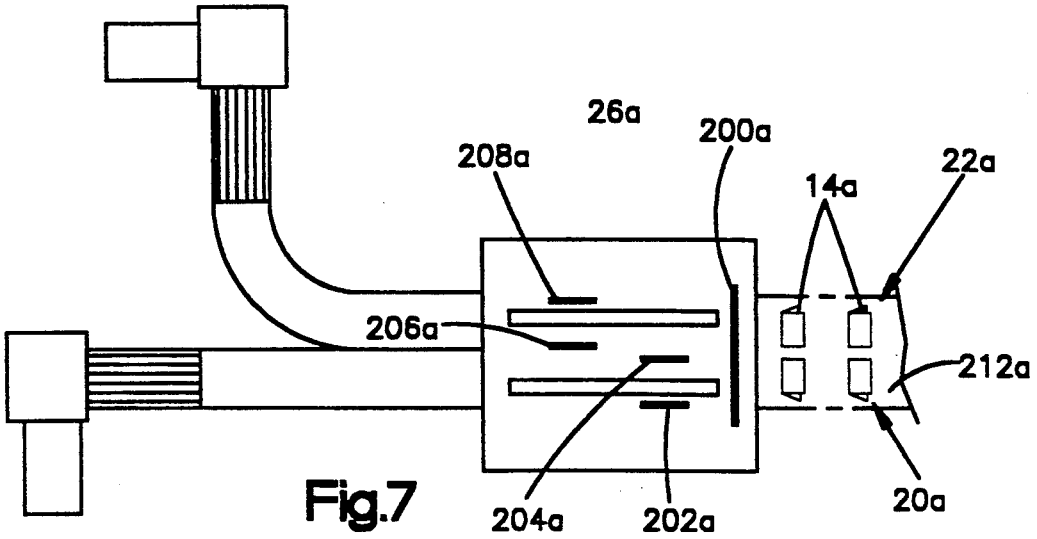
FIG. 7 is a schematic plan view of a second embodiment of the trimmer assembly.

The construction of a flying trimmer assembly, with offset side knives, is illustrated schematically in FIG. 7. Since the embodiment of the invention illustrated in FIG. 7 is generally similar to the embodiment of the invention illustrated in FIG. 1, similar numerals will be utilized to designate similar components, the suffix letter "a" being associated with the numerals of FIG. 7 to avoid confusion.

The trimmer assembly 26*a* includes a front knife 200*a* which extends across the streams 20*a* and 22*a* of signatures. The front knife 200*a* is reciprocated vertically to simultaneously trim the open edge portions of the signatures 14*a* in the two streams 20*a* and 22*a*. Side knives 202*a* and 204*a* extend parallel to the path of movement of the stream 20*a* of signatures through the trimmer assembly 26*a* and are reciprocated vertically to trim head and foot edge portions of the signatures. In addition, side knives 206*a* and 208*a* extend parallel to the path of movement of the stream 22*a* of signatures through the trimmer assembly 26*a* and are reciprocated vertically to trim the head and foot edge portions of signatures in the stream 22*a*.

The trimmer assembly 26*a* is of the known flying type in which the signatures are continuously moving while they are in the trimmer assembly. Thus, the front knife 200*a* is mounted on a movable front table which is reciprocated along the path of movement of the signatures through the trimmer assembly 26*a*. The side knives 200*a*–208*a* are mounted on a movable side table which is reciprocated through forward and return strokes along the path of movement of streams 20*a* and 22*a* of signatures through the trimmer assembly 26*a*. The signatures 14*a* are moved from the front knife table to the side knife table by conveyor assemblies. The conveyor assembly associated with the side knives 202*a* and 204*a* is shorter than the conveyor assembly associated with the side knives 206*a* and 208*a*. The trimmer assembly 26*a* has a construction which corresponds to the construction of the trimmer assembly disclosed in U.S. Pat. No. 3,733,947.

Conclusion

The present invention relates to a new and improved sheet material handling apparatus 10 having an improved feed mechanism 50 for feeding signatures 14 from a hopper 12 to a pair of conveyors 16 and 18. The improved feed mechanism 50 includes an extractor 66 which sequentially grips edge portions of signatures 14 and moves the signatures along an arcuate path into engagement with either a movable stop 74 or a stationary stop 84 which is disposed further along the arcuate path than the movable stop. The signatures 14 which engage the movable stop 74 are transferred to a first conveyor 16 of the pair of conveyors. The signatures which engage the stationary stop 84 are transferred to a second conveyor 18 of the pair of conveyors. The first stop 74 is movable so that it can be retracted out of the arcuate path of movement of the signatures 14 to enable every second signature to move into engagement with the stationary stop 84. This results in half of the signatures from a hopper 12 being transferred to the first conveyor 16 to form a first stream 20 of signatures and the other half of the signatures being transferred to the second conveyor 18 to form a second stream 22 of signatures.

A single stitcher assembly 24 is provided to stitch signatures 14 in the first and second streams 20 and 22 of signatures. In addition, a single trimmer assembly 26 is provided to trim the signatures in the first and second streams 20 and 22 of signatures. Since half of the signatures 14 are fed from each hopper 12 to each conveyor 16 or 18 to form two streams 20 and 22 of signatures, the conveyors 16 and 18, stitcher assembly 24 and trimmer assembly 26 can all be operated at a relatively slow rate which is equal to one-half of the rate at which signatures are fed from the hoppers.

Having described specific preferred embodiments of the invention, the following is claimed:

1. A sheet material handling apparatus comprising hopper means for holding a plurality of signatures, first and second spaced apart conveyor means for conveying first and second streams of signatures, and feed means for feeding signatures from said hopper means to said first and second conveyor means, said feed means including extractor means for sequentially gripping signatures which are at least partially disposed in said hopper means and for sequentially moving the gripped signatures away from said hopper means along an arcuate path, first stop means disposed at a first location along the arcuate path, said first stop means being movable between an extended position extending into the path of movement of a leading edge portion of a signature being moved by said extractor means and a retracted position in which said first stop means is out of the path of movement of the leading edge portion of a signature, second stop means disposed at a second location which is further along the arcuate path from said hopper means than the first location, means for moving said first stop means between the extended and retracted positions during operation of said feed means to enable some of the signatures to engage said first stop means when said first stop means is in the extended position and to enable other of the signatures to move past said first stop means into engagement with said second stop means when said first stop means is in the retracted position, first transfer means for transferring onto said first conveyor means signatures which engage said first stop means when said first stop means is in the extended position, and second transfer means for transferring onto said second conveyor means signatures which engage said second stop means.

2. A sheet material handling apparatus as set forth in claim 1 wherein said extractor means includes an extractor drum having a circular peripheral surface, said first stop means projecting outwardly of the circular peripheral surface of said extractor drum when said first stop means is in the extended position, said first stop means being disposed inwardly of the circular peripheral surface of said extractor drum when said first stop means is in the retracted position.

3. A sheet material handling apparatus as set forth in claim 2 wherein said means for moving said first stop means between the extended and retracted positions includes means for moving said first stop means in a generally radial direction relative to said extractor drum.

4. A sheet material handling apparatus as set forth in claim 1 further including a single stitcher assembly for stitching signatures being conveyed by said first and second conveyor means, said stitcher assembly including a first stitcher head for stitching signatures conveyed by said first conveyor means, a second stitcher head for stitching signatures conveyed by said second conveyor means, and drive means connected with said first and second stitcher heads for effecting operation of said first and second stitcher heads to stitch signatures conveyed by said first and second conveyor means.

5. A sheet material handling apparatus as set forth in claim 1 further including a single trimmer assembly for trimming signatures transported from said feed means in two spaced apart streams by said first and second conveyor means while the signatures remain in two spaced apart streams of signatures.

6. A sheet material handling apparatus as set forth in claim 1 wherein the signatures are folded, said extractor means including means for gripping the folded edge portions of the signatures while the signatures are at least partially in said hopper means and for sequentially moving signatures out of said hopper means along an arcuate path with the folded edge potions of the signatures leading, said first stop means being engageable with the folded edge portion of a signature to block movement of the signature along the arcuate path.

7. A sheet material handling apparatus as set forth in claim 6 wherein said first transfer means includes means for opening signatures after the folded edge portions of the signatures engage said first stop means and for moving the opened signatures onto said first conveyor means.

8. A sheet material handling apparatus a set forth in claim 7 wherein said second stop means is engageable with the folded edge portion of a signature to block movement of the signature along the arcuate path, said second transfer means including means for opening signatures after the folded edge portions of the signatures engage said second stop means and for moving the opened signatures onto said second conveyor means.

9. A sheet material handling apparatus as set forth in claim 1 wherein the signatures are folded, said first conveyor means being of the saddle type and having a first longitudinally extending ridge portion for engaging the inside of a signature adjacent to a fold in the signature with side panels of the signature on opposite sides of the first longitudinally extending ridge portion, said second conveyor means being of the saddle type and having a second longitudinally extending ridge portion for engaging the inside of a signature adjacent to a fold in the signature with side panels of the signature on opposite sides of the second longitudinally extending ridge portion.

10. A sheet material handling apparatus as set forth in claim 9 wherein said first transfer means includes means for opening signatures after the folded edge portions of the signatures engage said first stop means and for moving the opened signatures onto said first conveyor means with side panels of the opened signatures on opposite sides of said first ridge portion, said second transfer means including means for opening signatures after the folded edge portions of the signatures engage said second stop means and for moving the opened signatures onto said second conveyor means with side panels of the opened signatures on opposite sides of said second ridge portion.

11. A sheet material handling apparatus as set forth in claim 1 wherein said extractor means includes a drum which is rotatable to move signatures along the arcuate path and a plurality of grippers mounted on said drum for gripping edge portions of signatures at least partially disposed in said hopper means.

12. A sheet material handling apparatus comprising hopper means for holding a plurality of signatures, first and second conveyor means for conveying first and second spaced apart streams of signatures away from said hopper means, feed means for feeding signatures from said hopper means to said first and second conveyor means to form the first and second streams of signatures, and a single stitcher assembly for stitching signatures in the first and second spaced apart streams of signatures, said stitcher assembly including a first stitcher head for stitching signatures in the first stream of signatures, a second stitcher head for stitching signatures in the second stream of signatures, and a single drive assembly connected with said first and second stitcher heads for effecting operation of said first and second stitcher heads to stitch the first and second streams of signatures.

13. A sheet material handling apparatus as set forth in claim 12 wherein said hopper means includes a plurality of hoppers for holding signatures, said feed means including means for feeding signatures from each of said hoppers onto each of said first and second conveyor means.

14. A sheet material handling apparatus comprising first and second conveyor means for conveying first and second spaced apart streams of signatures and a single trimmer assembly for receiving the first and second spaced apart streams of signatures and for trimming the signatures while maintaining the signatures in the first and second spaced apart streams of signatures, said trimmer assembly including a front knife which extends across the first and second streams of signatures and means for reciprocating said front knife to simultaneously trim signatures in the first stream of signatures and signatures in the second stream of signatures.

15. A sheet material handling apparatus as set forth in claim 14 wherein said trimmer assembly further includes means for conveying the first and second streams of signatures through said trimmer assembly with the first and second streams of signatures in a spaced apart relationship.

16. A sheet material handling apparatus comprising hopper means for holding a plurality of signatures, first and second conveyor means for conveying first and second spaced apart streams of signatures away from said hopper means, feed means for feeding signatures from said hopper means to said first and second conveyor means to form the first and second streams of signatures, and a single stitcher assembly for stitching signatures in the first and second spaced apart streams of signatures, said stitcher assembly including a first stitcher head for stitching signatures in the first stream of signatures, a second stitcher head for stitching signatures in the second stream of signatures, and a single drive assembly connected with said first and second stitcher heads for effecting operation of said first and second stitcher heads to stitch the first and second streams of signatures, said feed means being operable to feed signatures from said hopper means at a first rate, said first and second stitcher heads being operable by said single drive assembly to stitch signatures at a second rate, said second rate being one half of said first rate.

17. An apparatus as set forth in claim 16 wherein said first and second conveyor means extend through said single stitcher assembly, said first stitcher head being operable to stitch signatures being conveyed by said first conveyor means, said second stitcher head being operable to stitch signatures being conveyed by said second conveyor means.

18. A sheet material handling apparatus as set forth in claim 17 wherein said single drive assembly extends across said first and second conveyor means.

19. A sheet material handling apparatus as set forth in claim 16 wherein said first and second stitcher heads are offset from each other along the path of movement of the first and second streams of signatures through said single stitcher assembly, said first and second conveyor means being operable to convey signatures in the first and second streams of signatures through said single stitcher assembly with the signatures in the first stream of signatures offset from the signatures in the second stream of signatures along the paths of movement of the first and second streams of signatures through said single stitcher assembly, said first and second stitcher heads being simultaneously operable by said single drive assembly to simultaneously stitch signatures disposed in said first and second streams of signatures at locations which are offset along the paths of movement of the first and second streams of signatures through said single stitcher assembly.

20. A sheet material handling apparatus as set forth in claim 16 wherein said first stitcher head is disposed adjacent to said first conveyor means and the first stream of signatures, said second stitcher head being disposed adjacent to said second conveyor means and the second stream of signatures, said single drive assembly including means connected with said first stitcher head and with said second stitcher head for reciprocating said first and second stitcher heads in unison along the paths of movement of the first and second streams of signatures through said stitcher assembly.

21. A sheet material handling apparatus as set forth in claim 16 wherein said single drive assembly includes an input shaft, first linkage means connected with said input shaft and said first stitcher head for reciprocating said first stitcher head and second linkage means connected with said input shaft and said second stitcher head for reciprocating said second stitcher head.

22. A sheet material handling apparatus as set forth in claim 16 wherein said first stitcher head is disposed above said first conveyor means and said second stitcher head is disposed above said second conveyor means, said single drive assembly including means for reciprocating said first and second stitcher heads in unison, said means for reciprocating said first and second stitcher heads being disposed adjacent to a side of said first conveyor means opposite from said second conveyor means.

23. A sheet material handling apparatus as set forth in claim 22 wherein said means for reciprocating said first and second stitcher heads in unison extends across said first conveyor means to said second stitcher head.

24. A sheet material handling apparatus as set forth in claim 16 wherein the signatures are folded, said first conveyor means is a saddle type conveyor having a ridge portion for engaging inner side surfaces of signatures adjacent to folds in the signatures, said feed means including an extractor means for sequentially gripping folded edge portions of signatures at least partially disposed in said hopper means and for sequentially moving the signatures along an arcuate path with the folded edge portions of the signatures leading, stop means movable between an extended position to engage the folded leading edge portion of a signature being moved along the arcuate path by said extractor means and a retracted position in which said stop means is ineffective to engage the folded leading edge portion of a signature being moved along the arcuate path by said extractor means to enable signatures to be moved past said stop means by said extractor means, first opener means for opening signatures which engage said stop means when said stop means is in the extended position and for moving the opened signatures onto said first conveyor means, and means for engaging signatures which move past said stop means when said stop means is in the retracted position and for moving the engaged signatures onto said second conveyor means.

25. A sheet material handling apparatus as set forth in claim 16 further including a single trimmer assembly for trimming signatures transported from said stitcher assembly while the signatures remain in two spaced apart streams of signatures.

26. A sheet material handling apparatus as set forth in claim 25 wherein said trimmer assembly includes a front knife for simultaneously trimming an edge portion of a signature in the first stream of signatures and an edge portion of a signature in the second stream of signatures and a plurality of side knives for simultaneously trimming head and foot portions of a signature in the first stream of signatures and a signature in the second stream of signatures.

27. A sheet material handling apparatus as set forth in claim 16 wherein said hopper means includes a plurality of hoppers for holding signatures, said feed means including means for feeding signatures from each of said hoppers onto each of said first and second conveyor means.

28. A sheet material handling apparatus comprising hopper means for holding a plurality of signatures, first and second conveyor means for conveying first and second spaced apart streams of signatures away from said hopper means, feed means for feeding signatures from said hopper means to said first and second conveyor means to form the first and second streams of signatures, and a single stitcher assembly for stitching signatures in the first and second spaced apart streams of signatures, said stitcher assembly including a first stitcher head for stitching signatures in the first stream of signatures, a second stitcher head for stitching signatures in the second stream of signatures, and a single drive assembly connected with said first and second stitcher heads for effecting operation of said first and second stitcher heads to stitch the first and second streams of signatures, said first and second conveyor means extend through said single stitcher assembly, said first stitcher head being operable to stitch signatures being conveyed by said first conveyor means, said second stitcher head being operable to stitch signatures being conveyed by said second conveyor means.

29. A sheet material handling apparatus as set forth in claim 28 wherein said single drive assembly extends across said first and second conveyor means.

30. A sheet material handling apparatus as set forth in claim 28 wherein said first and second stitcher heads are offset from each other along the path of movement of the first and second streams of signatures through said single stitcher assembly, said first and second conveyor means being operable to convey signatures in the first and second streams of signatures through said single stitcher assembly with the signatures in the first stream of signatures offset from the signatures in the second stream of signatures along the paths of movement of the first and second streams of signatures through said single stitcher assembly, said first and second stitcher heads being simultaneously operable by said single drive assembly to simultaneously stitch signatures disposed in said first and second streams of signatures at locations which are offset along the paths of movement of the first and second streams of signatures through said single stitcher assembly.

31. A sheet material handling apparatus as set forth in claim 28 wherein said first stitcher head is disposed adjacent to said first conveyor means and the first stream of signatures, said second stitcher head being disposed adjacent to said second conveyor means and the second-stream of signatures, said single drive assembly including means connected with said first stitcher head and with said second stitcher head for reciprocating said first and second stitcher heads in unison along the paths of movement of the first and second streams of signatures through said stitcher assembly.

32. A sheet material handling apparatus as set forth in claim 28 wherein said single drive assembly includes an input shaft, first linkage means connected with said input shaft and said first stitcher head for reciprocating said first stitcher head and second linkage means connected with said drive shaft and said second stitcher head for reciprocating said second stitcher head.

33. A sheet material handling apparatus as set forth in claim 28 wherein said first stitcher head is disposed above said first conveyor means and said second stitcher head is disposed above said second conveyor means, said single drive assembly including means for reciprocating said first and second stitcher heads in unison, said means for reciprocating said first and second stitcher heads being disposed adjacent to a side of said first conveyor means opposite from said second conveyor means.

34. A sheet material handling apparatus as set forth in claim 33 wherein said means for reciprocating said first and second stitcher heads in unison extends across said first conveyor means to said second stitcher head.

35. A sheet material handling apparatus as set forth in claim 28 wherein the signatures are folded, said first conveyor means is a saddle type conveyor having a ridge portion for engaging inner side surfaces of signatures adjacent to folds in the signatures, said feed means including an extractor means for sequentially gripping folded edge portions of signatures at least partially disposed in said hopper means and for sequentially moving the signatures along an arcuate path with the folded edge portions of the signatures leading, stop means movable between an extended position to engage the folded leading edge portion of a signature being moved along the arcuate path by said extractor means and a retracted position in which said stop means is ineffective to engage the folded leading edge portion of a signature being moved along the arcuate path by said extractor means to enable signatures to be moved past said stop means by said extractor means, first opener means for opening signatures which engage said stop means when said stop means is in the extended position and for moving the opened signatures onto said first conveyor means, and means for engaging signatures which move past said stop means when said stop means is in the retracted position and for moving the engaged signatures onto said second conveyor means.

36. A sheet material handling apparatus as set forth in claim 28 further including a single trimmer assembly for trimming signatures transported from said stitcher assembly while the signatures remain in two spaced apart streams of signatures.

37. A sheet material handling apparatus as set forth in claim 36 wherein said trimmer assembly includes a front knife for simultaneously trimming an edge portion of a signature in the first stream of signatures and an edge portion of a signature in the second stream of signatures and a plurality of side knives for simultaneously trimming head and foot portions of a signature in the first stream of signatures and a signature in the second stream of signatures.

38. A sheet material handling apparatus comprising hopper means for holding a plurality of signatures, first and second conveyor means for conveying first and second spaced apart streams of signatures away from said hopper means, feed means for feeding signatures from said hopper means to said first and second conveyor means to form the first and second streams of signatures, and a single stitcher assembly for stitching signatures in the first and second spaced apart streams of signatures, said stitcher assembly including a first stitcher head for stitching signatures in the first stream of signatures, a second stitcher head for stitching signatures in the second stream of signatures, and a single drive assembly connected with said first and second stitcher heads for effecting operation of said first and second stitcher heads to stitch the first and second streams of signatures, said first stitcher head being disposed adjacent to said first conveyor means and the first stream of signatures, said second stitcher head being disposed adjacent to said second conveyor means and the second stream of signatures, said single drive assembly including means connected with said first stitcher head and with said second stitcher head for reciprocating said first and second stitcher heads in unison along the paths of movement of the first and second streams of signatures through said stitcher assembly.

39. A sheet material handling apparatus as set forth in claim 38 wherein said single drive assembly includes an input shaft, said means connected with said first stitcher head and with said second stitcher head for reciprocating said first and second stitcher heads in unison including first linkage means connected with said drive shaft and said first stitcher head for reciprocating said first stitcher head under the influence of force transmitted from said drive shaft to said first stitcher head through said first linkage means and second linkage means connected with said drive shaft and said second stitcher head for reciprocating said second stitcher head under the influence of force transmitted from said drive shaft through said second linkage means.

40. A sheet material handling apparatus as set forth in claim 38 wherein said first stitcher head is disposed above said first conveyor means and said second stitcher head is disposed above said second conveyor means, said means for reciprocating said first and second stitcher heads in unison being disposed adjacent to a side of said first conveyor means opposite from said second conveyor means.

41. A sheet material handling apparatus as set forth in claim 40 wherein said means for reciprocating said first and second stitcher heads in unison extends across said first conveyor means to said second stitcher head.

42. A sheet material handling apparatus as set forth in claim 38 wherein the signatures are folded, said first conveyor means is a saddle type conveyor having a ridge portion for engaging inner side surfaces of signatures adjacent to folds in the signatures, said feed means including an extractor means for sequentially gripping folded edge portions of signatures at least partially disposed in said hopper means and for sequentially moving the signatures along an arcuate path with the folded edge portions of the signatures leading, stop means movable between an extended position to engage the folded leading edge portion of a signature being moved along the arcuate path by said extractor means and a retracted position in which said stop means is ineffective to engage the folded leading edge portion of a signature being moved along the arcuate path by said extractor means to enable signatures to be moved past said stop means by said extractor means, first opener means for opening signatures which engage said stop means when said stop means is in the extended position and for moving the opened signatures onto said first conveyor means, and means for engaging signatures which move past said stop means when said stop means is in the retracted position and for moving the engaged signatures onto said second conveyor means.

43. A sheet material handling apparatus comprising hopper means for holding a plurality of signatures, first and second conveyor means for conveying first and second spaced apart streams of signatures away from said hopper means, feed means for feeding signatures from said hopper to said first and second conveyor means to form the first and second streams of signatures, and a single stitcher assembly for stitching signatures in the first and second spaced apart streams of signatures, said stitcher assembly including a first stitcher head for stitching signatures in the first stream of signatures, a second stitcher head for stitching signatures in the second stream of signatures, and a single drive assembly connected with said first and second stitcher heads for effecting operation of said first and second stitcher heads to stitch the first and second streams of signatures, and a single trimmer assembly for trimming signatures transported from said stitcher assembly while the signatures remain in two spaced apart streams of signatures.

44. A sheet material handling apparatus as set forth in claim 43 wherein said single trimmer assembly includes first knife means for trimming signatures in the first stream of signatures, second knife means for trimming signatures in the second stream of signatures, and a single trimmer drive assembly connected with said first and second knife means for moving said first and second knife means relative to signatures in the first and second streams of signatures to trim the signatures.

45. A sheet material handling apparatus as set forth in claim 44 wherein said single trimmer assembly further includes third knife means having a single blade means which extends across the first and second streams of signatures for trimming signatures in the first and second streams of signatures, said single trimmer drive assembly being connected with said single blade means and being operable to move said single blade means relative to signatures in the first and second streams of signatures to trim the signatures.

46. A sheet material handling apparatus as set forth in claim 43 wherein said trimmer assembly includes a front knife for simultaneously trimming an edge portion of a signature in the first stream of signatures and an edge portion of a signature in the second stream of signatures and a plurality of side knives for simultaneously trimming head and foot portions of a signature in the first stream of signatures and a signature in the second stream of signatures.

47. A sheet material handling apparatus comprising hopper means for holding a plurality of signatures, first and second conveyor means for conveying first and second spaced apart streams of signatures, feed means for feeding signatures from said hopper means to said first and second conveyor means, said feed means including extractor means for sequentially gripping edge portions of signatures which are at least partially disposed in said hopper means and for sequentially moving the gripped signatures away from said hopper means along an arcuate path with the gripped edge portions of the signatures leading, first stop means at a first location along the arcuate path, said first stop means being movable between an extended position extending into the path of movement of the leading edge portion of a signature being moved by said extractor means and a retracted position in which said first stop means is out of the path of movement of the leading edge portion of a signature, second stop means disposed at a second location which is further along the arcuate path from said hopper means than the first location, first transfer means for transferring onto said first conveyor means signatures which engage said first stop means when said first stop means is in the extended position, and second transfer means for transferring onto said second conveyor means signatures which engage said second stop means, and a single trimmer assembly for receiving the first and second spaced apart streams of signatures and for trimming the signatures while maintaining the signatures in the first and second spaced apart streams of signatures, said trimmer assembly including a front knife which extends across the first and second streams of signatures and means for reciprocating said front knife to simultaneously trim signatures in the first stream of signatures and signatures in the second stream of signatures.

48. A sheet material handling apparatus as set forth in claim 47 further including a single stitcher assembly disposed along the paths of movement of the first and second streams of signatures at a location between said feed means and said trimmer assembly for stitching signatures in the first and second streams of signatures before the signatures are conveyed to said trimmer assembly, said stitcher assembly including a first stitcher head for stitching signatures in the first stream of signatures, a second stitcher head for stitching signatures in the second stream of signatures, and a single drive assembly connected with said first and second stitcher heads for effecting operation of said first and second stitcher heads to stitch the first and second streams of signatures.

49. A sheet material handling apparatus comprising first and second conveyor means for conveying first and second spaced apart streams of signatures and a signal trimmer assembly for receiving the first and second spaced apart streams of signatures and for trimming the signatures while maintaining the signatures in the first and second spaced apart streams of signatures, said trimmer assembly including a front knife which extends across the first and second streams of signatures, means for reciprocating said front knife to simultaneously trim signatures in the first stream of signatures and signatures in the second stream of signatures, a first side knife which is disposed adjacent to the first stream of signatures, means for reciprocating said first side knife to trim edge portions of signatures in the first stream of signatures, a second side knife which is disposed adjacent to the second stream of signatures, and means for reciprocating said second side knife to trim edge portions of signatures in the second stream of signatures.

50. A sheet material handling apparatus as set forth in claim 49 wherein said trimmer assembly further includes means for conveying the first and second streams of signatures through said trimmer assembly with the first and second streams of signatures in a spaced apart relationship.

51. A sheet material handling apparatus as set forth in claim 49 wherein said first side knife is disposed adjacent to the first stream of signatures at a first location spaced a first distance from said front knife along the path of movement of the first stream of signatures through said trimmer assembly and said second side knife is disposed adjacent to the second stream of signatures at a second location spaced a second distance from said front knife along the path of movement of the second stream of signatures through said trimmer assembly, said second distance being greater than said first distance.

52. A sheet material handling apparatus comprising first and second conveyor means for conveying first and second spaced apart streams of signatures and a single trimmer assembly for receiving the first and second spaced apart streams of signatures and for trimming the signatures while maintaining the signatures in the first and second spaced apart streams of signatures, said trimmer assembly including a front knife which extends across the first and second streams of signatures, means for reciprocating said front knife to simultaneously trim signatures in the first stream of signatures and signatures in the second stream of signatures, a first side knife which is disposed adjacent to the first stream of signatures at a first location spaced a first distance from said front knife along the path of movement of the first stream of signatures through said trimmer assembly, and a second side knife which is disposed adjacent to the second stream of signatures at a second location spaced a second distance from said front knife along the path of movement of the second stream of signatures through said trimmer assembly, said second distance being greater than said first distance.

* * * * *

UNITED STATES PATENT AND TRADEMARK OFFICE

CERTIFICATE OF CORRECTION

PATENT NO. : 5,100,118

DATED : March 31, 1992

INVENTOR(S) : John N. Hobbs and Robert A. Bryson Sr.

It is certified that error appears in the above-identified patent and that said Letters Patent is hereby corrected as shown below:

Column 18, Line 6, Claim 43, after "hopper" insert --means--.

Signed and Sealed this

Eighth Day of June, 1993

*Attest:*

Michael K. Kirk

MICHAEL K. KIRK

*Attesting Officer*

*Acting Commissioner of Patents and Trademarks*